US007217166B2

(12) United States Patent
Fukuoka et al.

(10) Patent No.: US 7,217,166 B2
(45) Date of Patent: May 15, 2007

(54) COWLING STRUCTURE FOR OUTBOARD MOTOR

(75) Inventors: Yoshihito Fukuoka, Shizuoka-ken (JP); Hirotoshi Yamauchi, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/320,216

(22) Filed: Dec. 28, 2005

(65) Prior Publication Data

US 2006/0166574 A1 Jul. 27, 2006

(30) Foreign Application Priority Data

Dec. 28, 2004 (JP) ..... 2004-378531

(51) Int. Cl.
*B63H 20/32* (2006.01)

(52) U.S. Cl. ..... 440/77

(58) Field of Classification Search ..... 440/77
See application file for complete search history.

(56) References Cited

U.S. PATENT DOCUMENTS 4,927,194 A * 5/1990 Wagner ..... 292/128
5,338,236 A * 8/1994 Dunham et al. ..... 440/77

FOREIGN PATENT DOCUMENTS

JP 60-060098 4/1985
JP 08-268384 10/1996

* cited by examiner

*Primary Examiner*—Stephen Avila
(74) *Attorney, Agent, or Firm*—Knobbe, Martens, Olson & Bear, LLP

(57) ABSTRACT

An outboard motor has a cowling structure that includes a top cowl and a bottom cowl. The top cowl has a hook mounting member which is bonded to an inner side of the top cowl. The hook mounting member has a top cowl hook configured to engage a bottom cowl hook mounted to the bottom cowl. The hook mounting member is formed by pressing a nonferrous metal plate. A hook fixing part of the housing mounting member is coupled to the top cowl hook and is formed by the way of drawing in the pressing process.

18 Claims, 11 Drawing Sheets

COWLING STRUCTURE FOR OUTBOARD MOTOR

RELATED APPLICATIONS

This application is based on and claims priority to Japanese Patent Application No. 2004-378531, filed Dec. 28, 2004, the entire contents of which is hereby expressly incorporated by reference.

BACKGROUND OF THE INVENTION

1. Field of the Invention

The present application generally relates to outboard motors, and more particularly to outboard motors with a cowling structure including a top cowl and a bottom cowl.

2. Description of the Related Art

Watercraft vehicles, such as boats, are often powered by an outboard motor having an internal combustion engine. Outboard motors can be used to propel watercraft. Outboard motors often have an engine disposed within a protective cowling. Protective cowlings typically include a top cowl and a bottom cowl. The top cowl is often releasably coupled to the bottom cowl so that the top cowl can be removed to expose the engine.

Japanese Patent Publication No. 60-60098, Japanese Patent Publication No. 02-32196, and Japanese Patent Publication No. 08-268384 disclose outboard motors that have top and bottom cowls coupled together by engaging bottom cowl hooks attached to an opening edge of the bottom cowl and top cowl hooks attached to an opening edge of the top cowl. These types of top cowls are often made of reinforced resin and thus are relatively heavy and non-recyclable. A bolt is often embedded in the top cowl and couples the top cowl hook to the top cowl. The bolt is typically embedded in a thickened portion of the top cowl, which is often formed by a die-cutting process. Unfortunately, the weight of the top cowl is undesirably increased due to this thickened portion.

Other outboard motor cowlings have top cowl hooks that are riveted to the top cowls. Unfortunately, the heads of the rivets are often on the outside of the top cowls and exposed to the external environment. These visible portions of the rivets may be unsightly and reduce the overall aesthetics of the outboard motor.

SUMMARY OF THE INVENTION

In some aspects of the present invention, an outboard motor comprises a cowling configured to enclose an engine therewithin. The cowling comprises a top cowl and a bottom cowl. The top cowl comprises a top cowl opening edge and a top cowl coupling assembly. The top cowl coupling assembly comprises a top cowl hook and a hook mounting member that is bonded to an inner side of the top cowl. The hook mounting member comprises a nonferrous metal and has a generally uniform thickness, the bottom cowl comprises a bottom cowl opening edge and a bottom cowl coupling assembly coupled to an inner side of the bottom cowl. The top cowl hook is configured to engage the bottom cowl coupling assembly so as to releasably couple the top cowl to the bottom cowl.

In other aspects of the present invention, a cowling for an outboard motor is provided. The cowling comprises a top cowl having an opening edge. A hook mounting plate is bonded to an inner surface of the top cowl near the opening edge. The hook mounting plate comprises a nonferrous metal and a central portion protruding from the inner surface of the top cowl. A top cowl hook is coupled to the central portion. A bottom cowl is configured to mate with the top cowl so as to enclose an engine therewithin. The bottom cowl has a bottom cowl hook coupled to an opening edge of the bottom cowl. The top cowl hook is configured to releasably engage the bottom cowl hook.

BRIEF DESCRIPTION OF THE DRAWINGS

The above-mentioned and other features of the invention disclosed herein are described below with reference to the drawings of a preferred embodiment. The illustrated embodiment is intended to illustrate, but not to limit the invention. The drawings contain the following figures.

DETAILED DESCRIPTION OF THE PREFERRED EMBODIMENT

Figure 1:
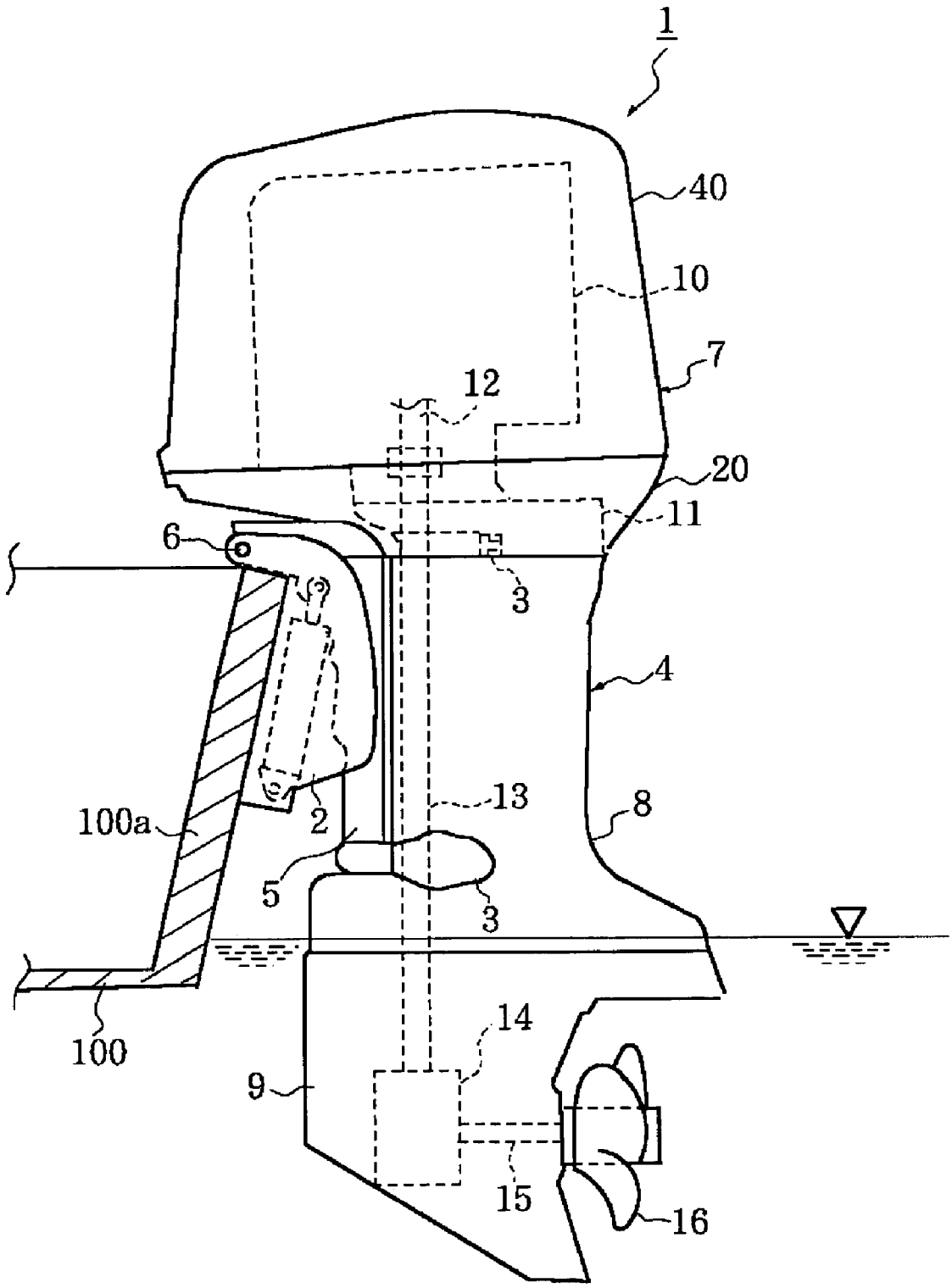
FIG. 1 is a side elevational view of an outboard motor configured in accordance with a preferred embodiment of the present invention. An associated watercraft, on which the outboard motor is mounted, is partially shown in section. Several of the internal components of the outboard motor are illustrated in phantom.

With reference to FIG. 1, a watercraft has an outboard motor 1 that is configured in accordance with certain features, aspects, and advantages of the present invention. The outboard motor 1 is a typical marine drive, and thus all the embodiments below are described in the context of an outboard motor. The embodiments, however, can be applied to other multi-piece cowlings, as will become apparent to those of ordinary skill in the art.

The illustrated watercraft of FIG. 1 has a hull 100 that can float in the water. The hull 100 carries the outboard motor 1, which has a propulsion unit 4 and an internal combustion engine 10 (shown in phantom). The engine 10 of the outboard motor 1 powers the propulsion unit 4 which propels the watercraft. The illustrated propulsion unit 4 is a single propeller system; however, other types of propulsion units can be used as well, such as, for example, a dual counter-rotational propeller system, a jet drive, and the like. The outboard motor 1 is supported on the transom 100*a* of the hull 100 by a clamp bracket 2 so as to place at least a portion of the propulsion unit 4 in a submerged position when the watercraft rests in the water.

A swivel bracket 5 is coupled to the clamping bracket 2. The swivel bracket 5 has upper and lower damper members 3 for supporting the propulsion unit 4. The clamp bracket 2 can be vertically rotated about the horizontal tilt shaft 6. The outboard motor 1 is preferably steerable and/or tiltable by moving the brackets 2, 5.

Figure 2:
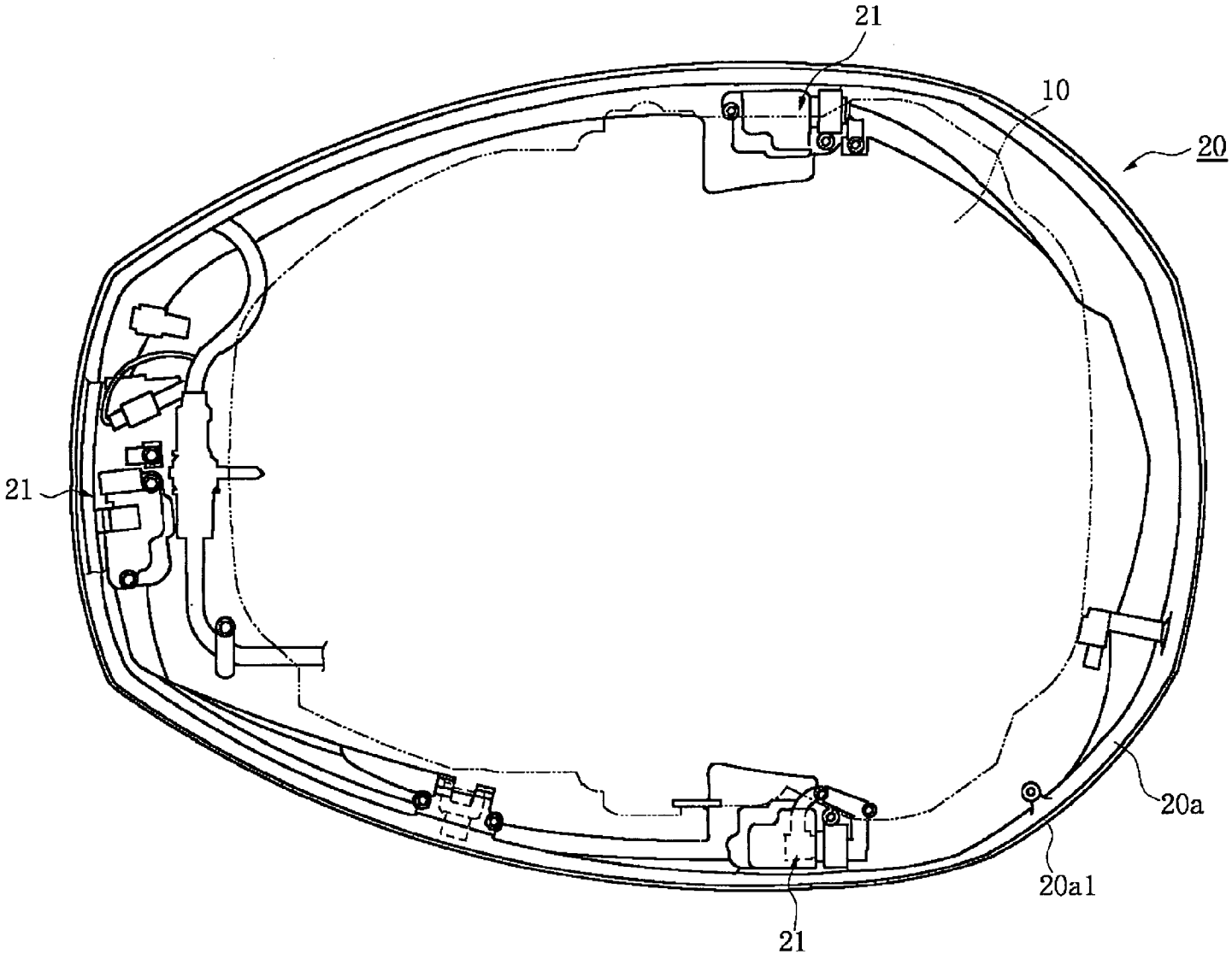
FIG. 2 is a top plan view of a bottom cowl that houses an engine. The engine is illustrated in phantom.

With reference to FIGS. 1 and 2, the illustrated outboard motor 1 includes the internal combustion engine 10 which is preferably a multi-cylinder, four-cycle engine. Engines having a different number of cylinders, other cylinder arrangements, various cylinder orientations (e.g., upright cylinder banks, and V-type), and operating on various combustion principles (e.g., four stroke, crankcase compression two-stroke, diesel, and rotary) are all practicable for use with the air intake system disclosed herein. The engine 10 comprises an engine body defining at least one cylinder bore therethrough. A cylinder head assembly is connected to the cylinder bore, and a piston is disposed within the cylinder bore. The cylinder bore, the cylinder head assembly, and the piston cooperate to define a variable combustion chamber.

The propulsion unit 4 has a housing formed by a cowling 7, an upper case 8, and a lower case 9. The upper case 8 is attached to the bottom of an exhaust guide 11. The engine 10, preferably a four-stroke engine, is supported by the exhaust guide 11 and surrounded by the cowling 7.

A crankshaft 12, disposed vertically in the engine 10, is connected to the upper end of a drive shaft 13 which extends vertically through the inner space of the upper case 8. The lower end of the drive shaft 13 is connected to a forward-reverse shifting mechanism 14. The forward-reverse shifting mechanism 14 is housed within the lower case 9. A propeller shaft 15 extends horizontally from the forward-reverse shifting mechanism 14. A propeller 16 is attached to the rear end of the propeller shaft 15 extending out of the lower case 9.

As shown in FIG. 1, the cowling 7 includes a bottom cowl 20 and a top cowl 40. The bottom cowl 20 and the top cowl 40 cooperate to define an engine compartment configured to accommodate the engine 10. In some embodiments, including the illustrated embodiment, a bottom portion of the engine 10 is disposed in the bottom cowl 20. The bottom cowl 20 preferably comprises metal, such as aluminum. The bottom cowl 20 can be formed by die-casting or other suitable manufacturing process.

Figure 3:
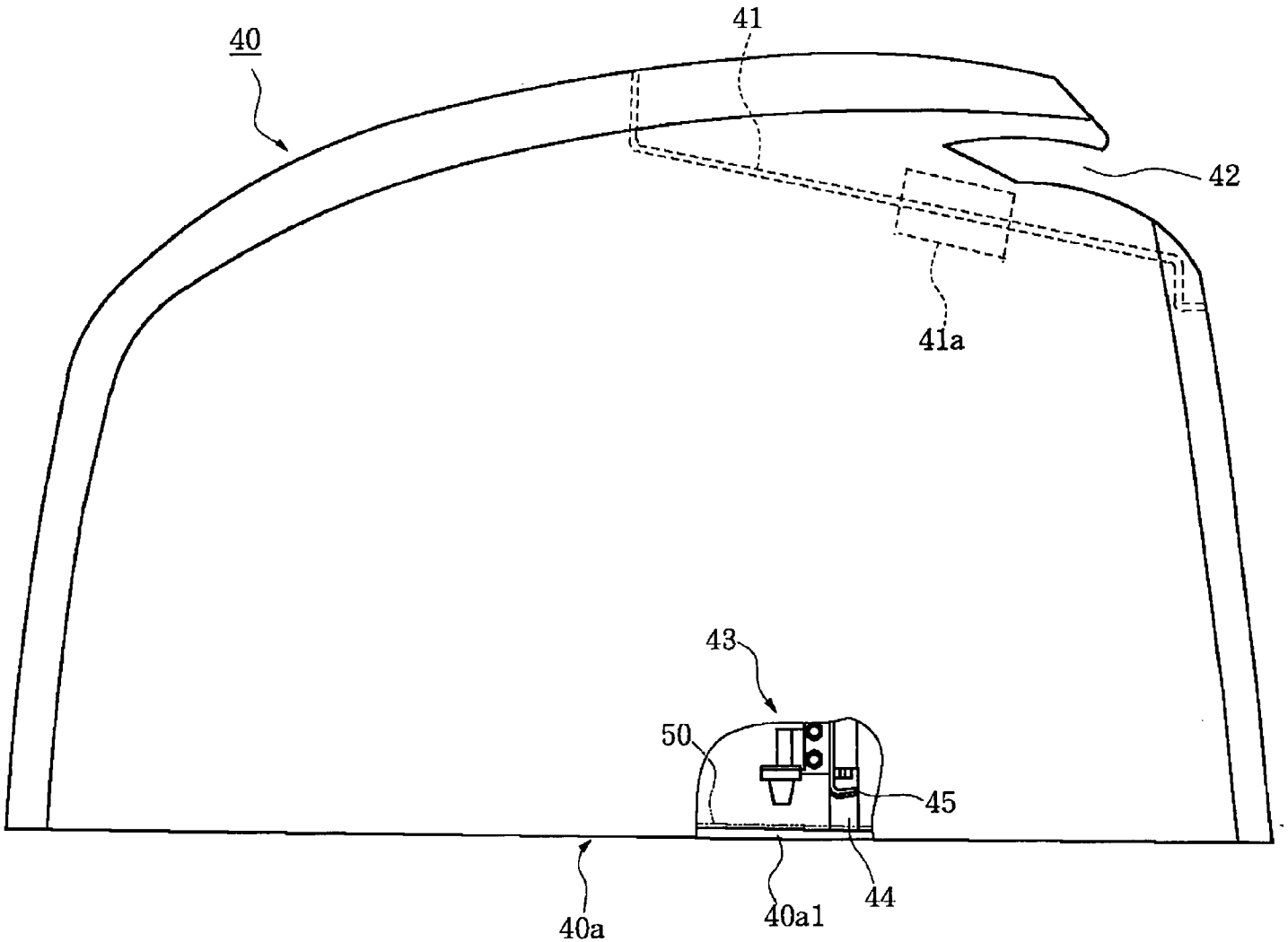
FIG. 3 is a cutaway side view of a top cowl.
Figure 4:
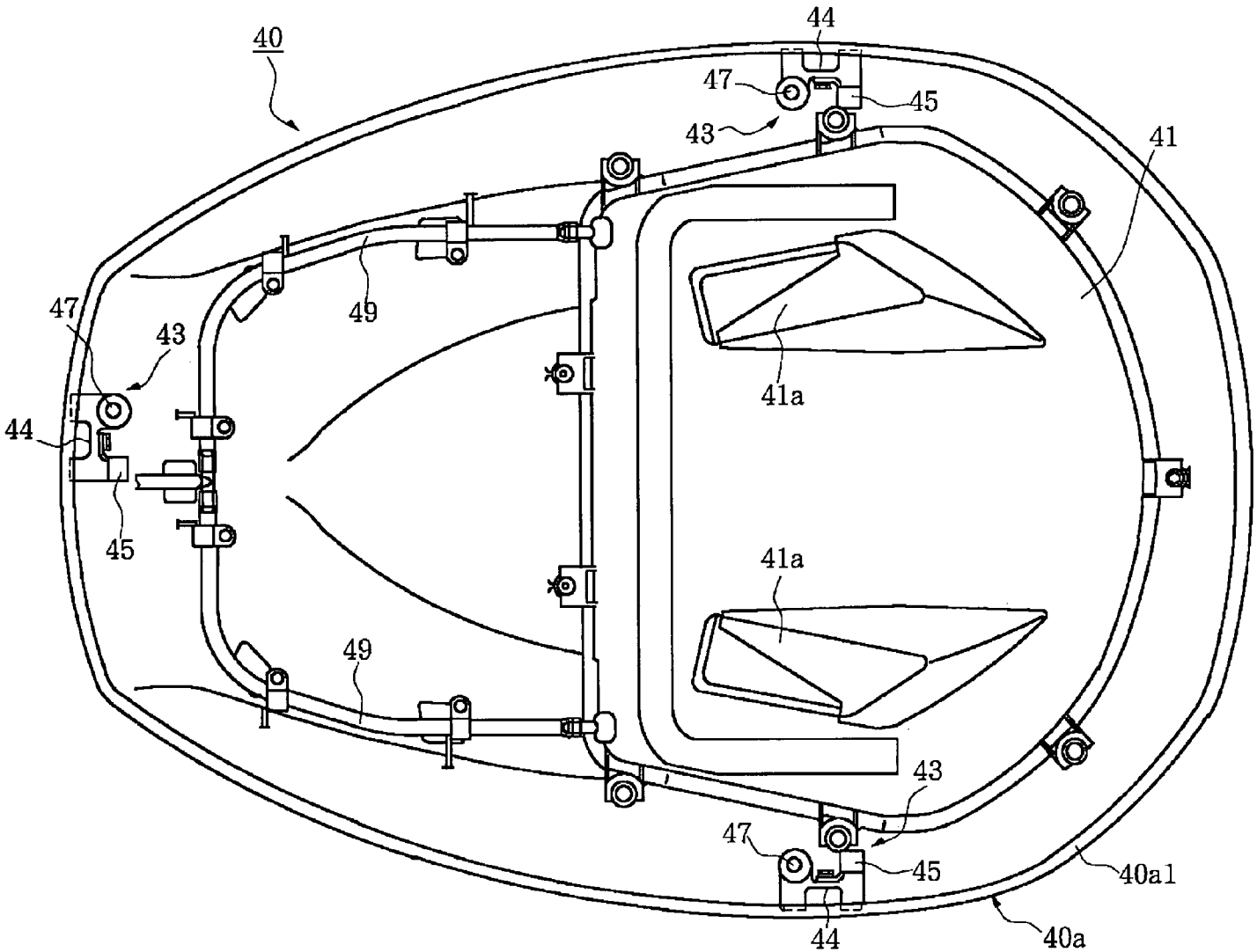
FIG. 4 is a bottom elevational view of the top cowl of FIG. 3.

As seen in FIGS. 3 and 4, the top cowl 40 includes a molding 41 positioned between the engine 10 and an intake opening 42 of the top cowl 40. The molding 41 has a pair of right and left air intake openings 41*a*. Air introduced through the intake opening 42 is drawn through the air intake openings 41*a*. The air then proceeds to the engine 10. The air can also be drawn into an air cleaner or other components of the outboard motor 1. Water drops on the molding 41 are collected and discharged through a discharge hose 49 (see FIG. 4) to limit the amount of water that reaches the engine 10.

Figure 7:
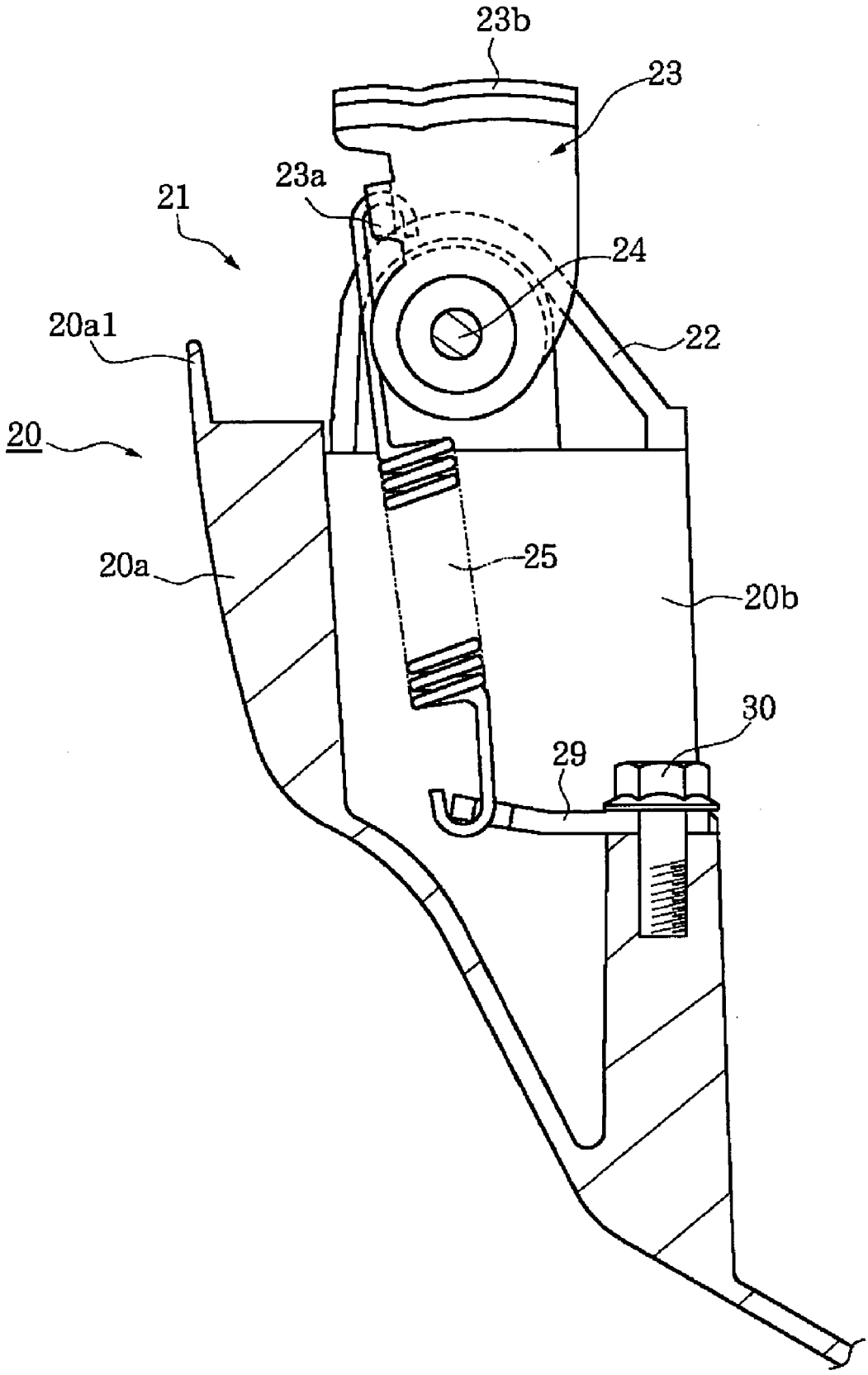
FIG. 7 is a cross-sectional view of the bottom cowl coupling assembly of FIG. 5 taken along the line VII—VII.
Figure 11:
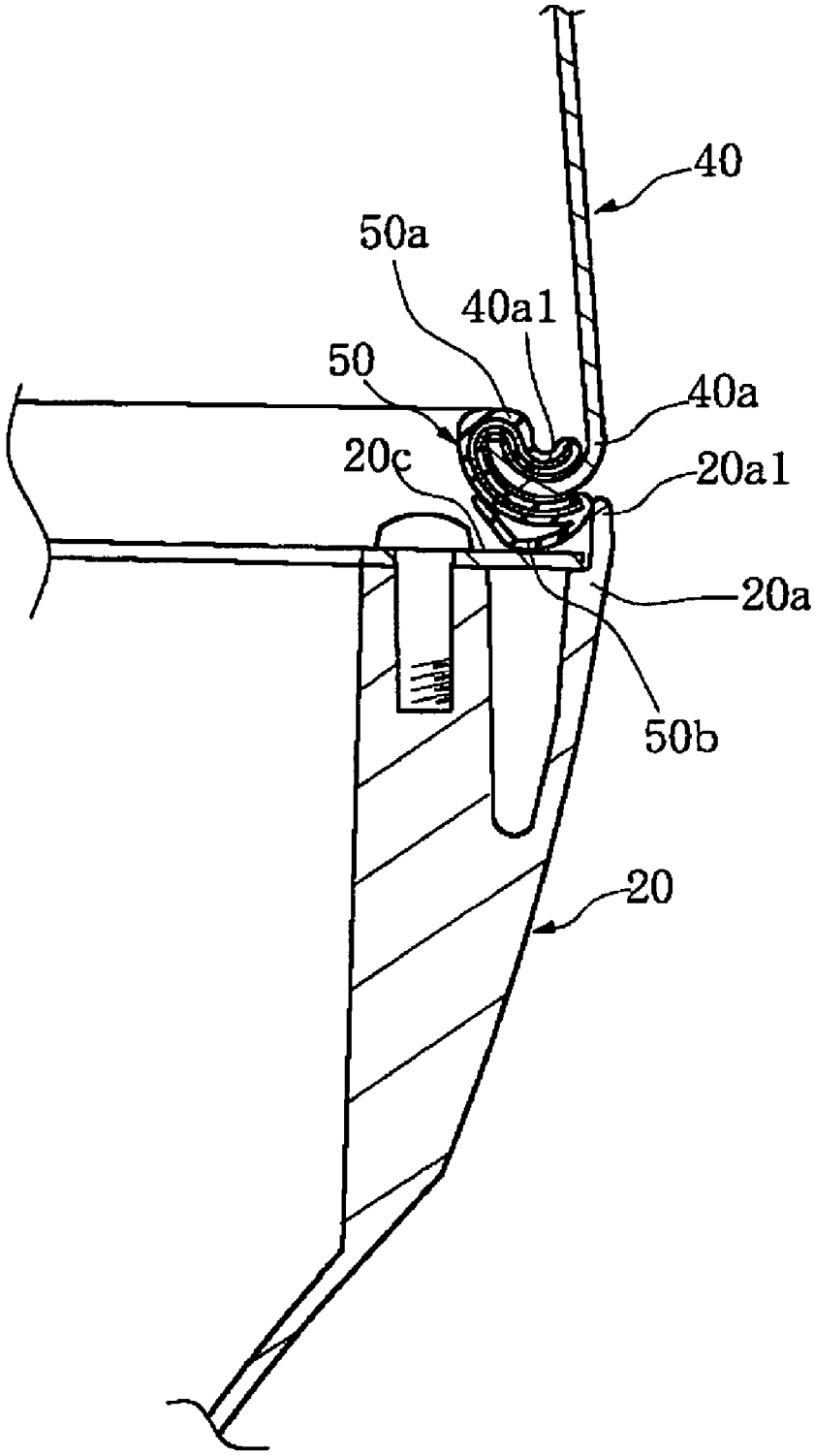
FIG. 11 is a cross-sectional view of a seal formed between the top cowl and bottom cowl.

With respect to FIGS. 1 and 2, the bottom cowl 20 has an opening edge 20*a* defining an opening configured to accommodate the engine 10 (shown in phantom in FIG. 2). A rib 20*a*1 extends outwardly from the edge 20*a*, as shown in FIGS. 7 and 11. The bottom cowl 20 includes one or more bottom cowl coupling assemblies 21 configured to engage the top cowl 40. The illustrated bottom cowl 20 includes three bottom cowl coupling assemblies 21. A pair of coupling assemblies 21 are positioned at opposing sides of the bottom cowl 20. Another coupling assembly 21 is positioned at the front of the opening edge 20. The coupling assemblies 21 can also be at other locations.

Figure 5:
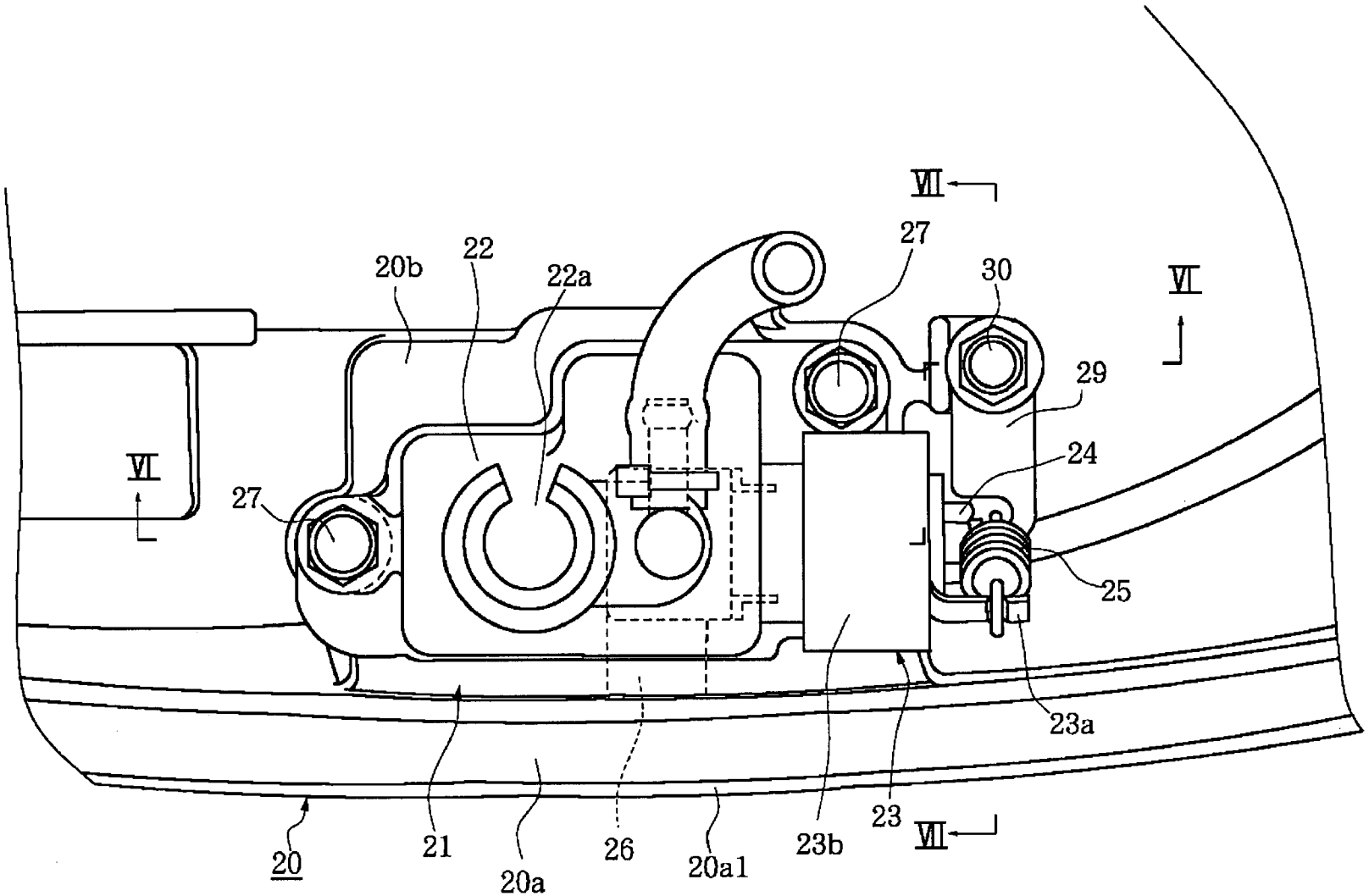
FIG. 5 is a top plan view of a bottom cowl coupling assembly of the bottom cowl.
Figure 6:
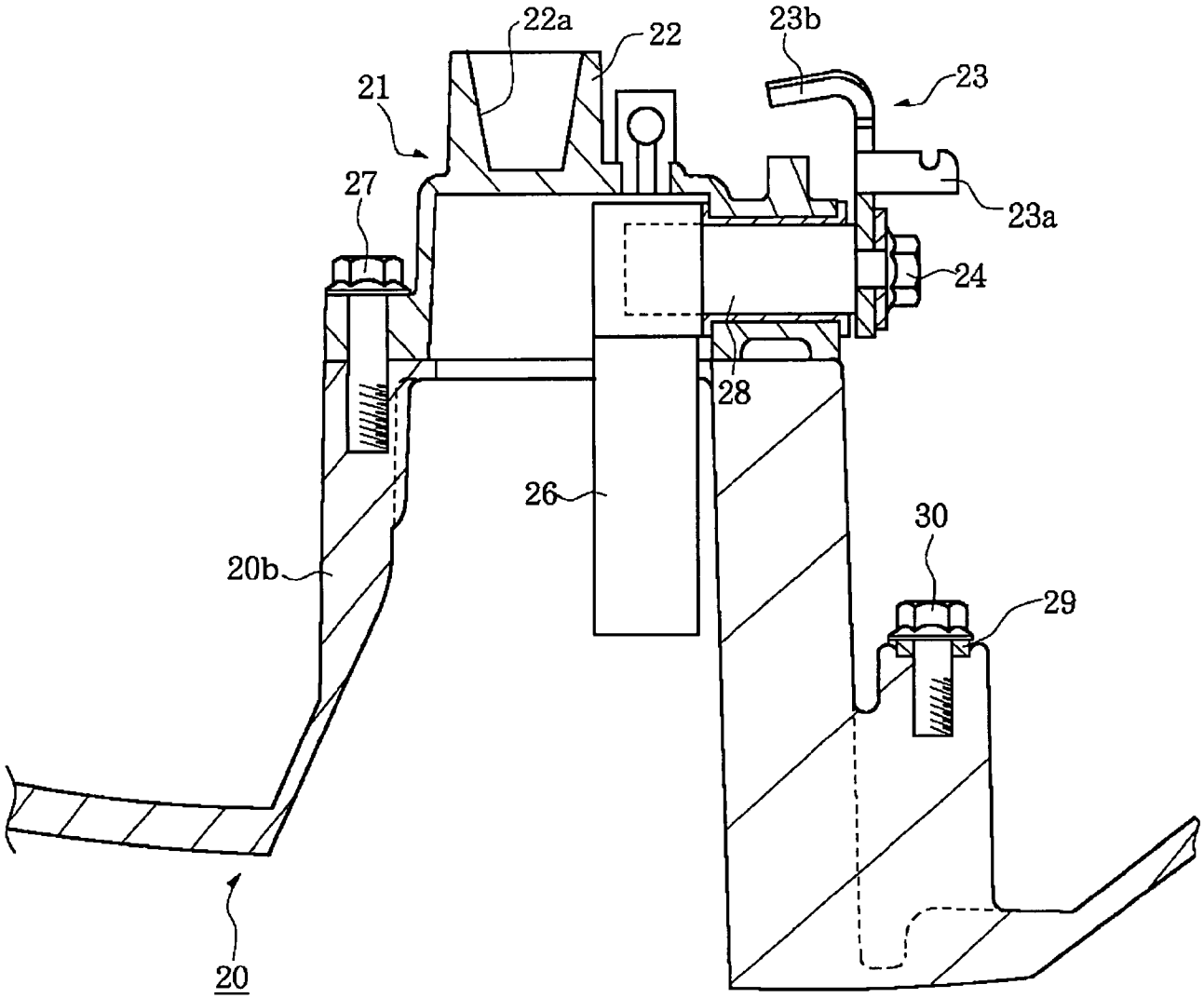
FIG. 6 is a cross-sectional view of the bottom cowl coupling assembly of FIG. 5 taken along the line VI—VI.

With respect to FIGS. 5 and 6, the bottom cowl coupling assembly 21 comprises a supporting holder 22, a bottom cowl hook 23, and a mounting bolt 24 that couples the bottom cowl hook 23 to the supporting holder 22. As shown in FIGS. 5 and 7, a spring 25 (not shown in FIG. 6) extends between one side of the bottom cowl hook 23 and a stay 29. The supporting holder 22 is secured to a mounting boss 20*b* extending inwardly from the opening edge 20*a* of the bottom cowl 20 towards the engine 10. One or more mounting fasteners 27, such as mounting bolts, can couple the supporting holder 22 to the mounting boss 20*b*.

As shown in FIG. 6, the mounting bolt 24 couples the bottom cowl hook 23 to a supporting shaft 28 extending horizontally from the lever 26. The supporting shaft 28 is rotatably supported by the supporting holder 22. The lever 26 and the bottom cowl hook 23 can be rotated together about an axis 112. The lever 26 extends vertically through the mounting boss 23*b*.

A mounting bolt 30 couples the stay 29 to the mounting boss 20*b*, as shown in FIG. 7. The spring 25 extends between the stay 29 and a supporting part 23*a* of the bottom cowl hook 23. In some embodiments, the spring 25 biases the engaging part 23*b* of the bottom cowl hook 23 towards the opening edge 20*a*. The illustrated spring 25 pulls the bottom cowl hook 23 about the mounting bolt 24, as indicated by the arrow 101 in FIG. 7.

With reference again to FIGS. 1 and 3, the top cowl 40 preferably comprises nonferrous metal formed by a pressing process. In some embodiments, for example, the top cowl 40 is formed by pressing a nonferrous metal plate, such as aluminum and magnesium plate, as detailed below.

Figure 8:
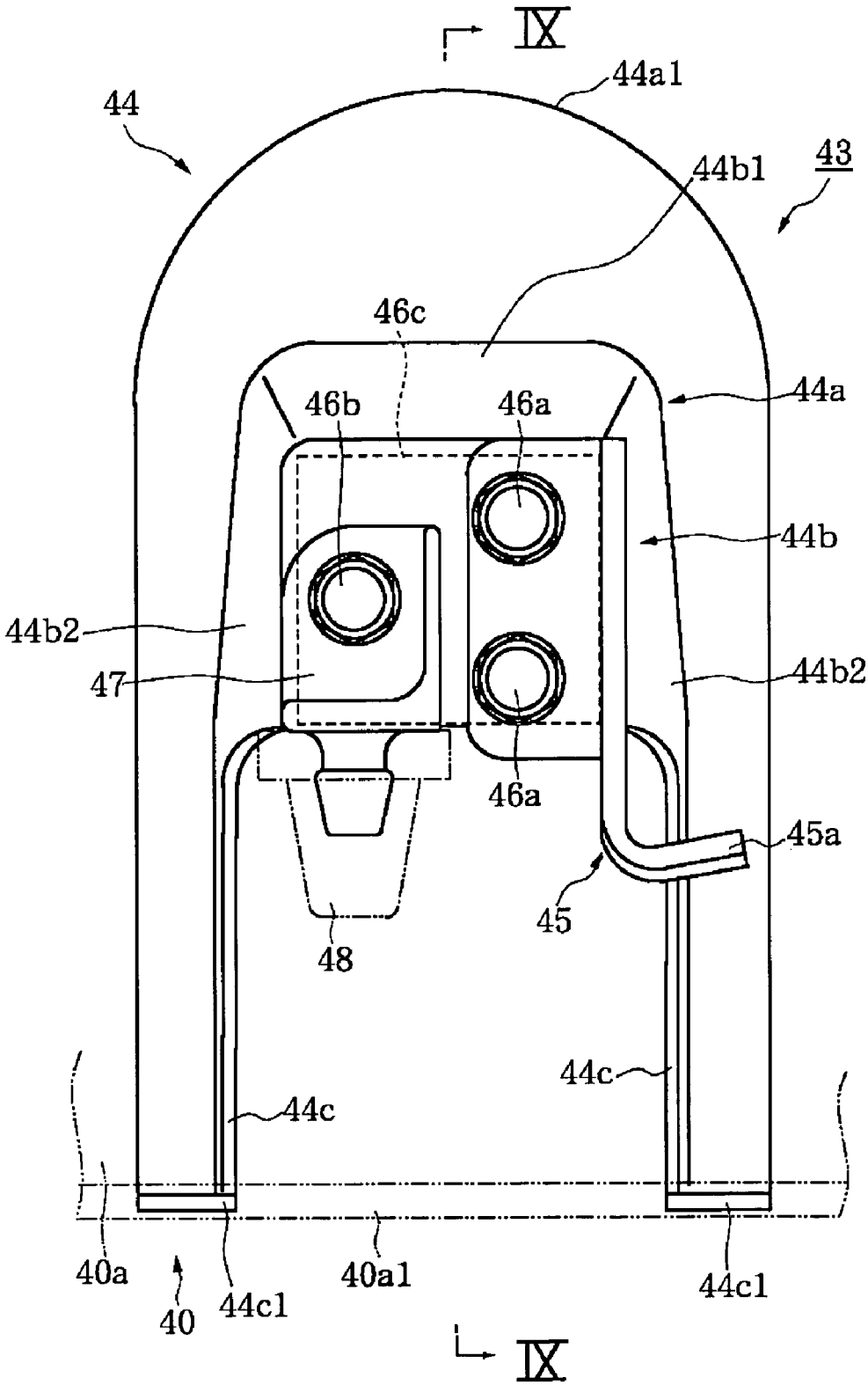
FIG. 8 is a plan view of a top cowl hook coupled to the top cowl as viewed from the interior of the top cowl.
Figure 9:
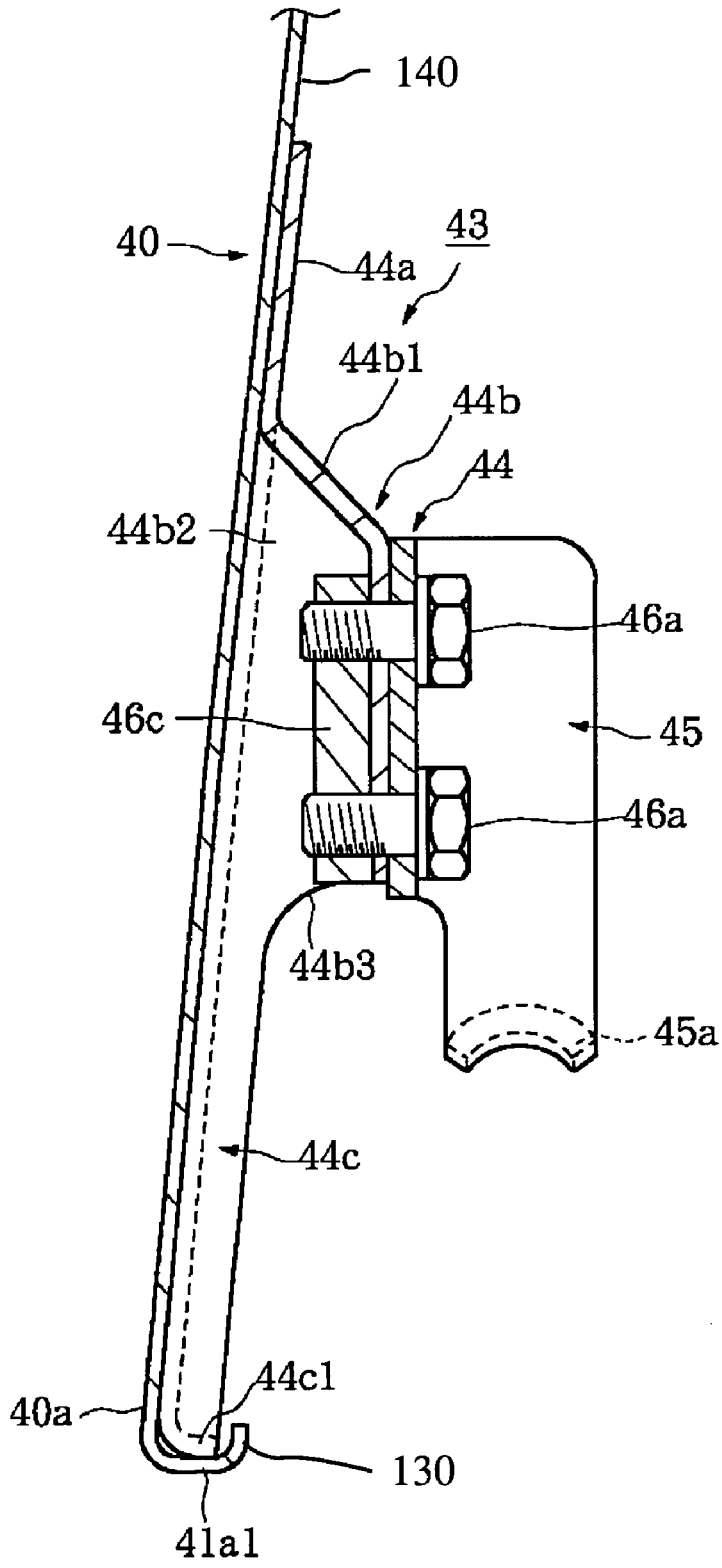
FIG. 9 is a cross-sectional view of the top cowl hook of FIG. 8 taken along the line IX—IX.

As shown in FIG. 9, the top cowl 40 has an opening edge 40*a* that extends inwardly. The illustrated opening edge 40*a* is bent inwardly to form a curved part 40*a*1. The curved part 40*a*1 preferably is formed by bending the opening edge 40*a* of the top cowl 40 inwardly into a curled shape (see FIGS. 8 and 9). In some embodiments, including the illustrated embodiment, the curved part 40*a*1 defines a generally U-shaped channel 130 sized to receive at least a portion of the top cowl coupling assembly 43. The open side of the channel 130 preferably faces upwardly and extends continuously or discontinuously along the opening edge 40*a*.

Top cowl coupling assemblies 43 are disposed on the interior of the top cowl 40 and cooperate with the bottom coupling assemblies 21 to releaseably couple the top cowl 40 to the bottom cowl 20. One, two, three, or more coupling assemblies 43 can be positioned along the interior of the top cowl 40. The illustrated top cowl 40 of FIG. 4 has three coupling assemblies 43. A pair of coupling assemblies 43 are positioned at opposing sides of the bottom cowl 20. Another coupling assembly 43 is positioned at the front of the opening edge 20. The coupling assemblies 43 of the top cowl 40 are preferably positioned such that they mate with the coupling assemblies 21 of the bottom cowl 20 when the top cowl 40 is placed on the bottom cowl 20.

As shown in FIGS. 8 and 9, the coupling assembly 43 of the top cowl 40 includes a hook mounting member 44, a top cowl hook 45, mounting bolts 46*a*, 46*b*, a nut plate 46*c*, a damper holder 47, and a positioning damper 48. The hook mounting member 44 can comprise a nonferrous material or other suitable material. The illustrated hook mounting member 44 is formed from a nonferrous metal plate. The metal plate is formed by a pressing process. The pressed metal plate is coupled (e.g., bonded, affixed, or otherwise attached) to the inner side 120 of the opening edge 40*a* of the top cowl 40. The illustrated hook mounting member 44 is bonded to the inner side 120 of the wall 140. As used herein, the term "bond" is a broad term and includes, without limitation, affixing, adhering, or other suitable means for coupling together the hook mounting member 44 to the wall 140, without having to use mechanical fasteners, such as bolts.

Welding, glue, adhesive, bonding material, and the like can be used to bond the hook mounting member 44 to the wall 140. However, in additionally embodiments mechanical fasteners can be used in combination with bonding to ensure that the hook mounting member 44 is securely coupled to the wall 140 of the top cowl 40, if desired.

The wall 140 of the top cowl 40 and the hook mounting member 44 can be made of the same or similar materials. In some embodiments, the wall 140 of the top cowl 40 and the hook mounting member 44 comprise a nonferrous metal, such as aluminum, magnesium, and combinations thereof. This can reduce the weight of the top cowling 40 as compared to the top cowlings comprising, e.g., reinforced resin. Additionally, corrosion of the hook mounting member 44 and/or the top cowl 40 can be reduced. In some embodiments, at least the portions of the hook mounting member 44 and the wall 140 contacting each other can be made of the same material, preferably a nonferrous metal.

With reference to FIGS. 8 and 9, the hook mounting member 44 preferably includes a bonding part 44*a*, a hook fixing part 44*b* and elongate positioning legs 44*c*. The hook fixing part 44*b* is formed by drawing during the pressing process. In some embodiments, the edges of the mounting member 44 are restrained while the hook fixing part 44*b* is stretched, or drawn, into the desired shape. As such, the costs of production and the cross-length of a space defined by the hook fixing part 44*b* and the top cowl 40 can be reduced. An upper side 44*b*1 and a left and a right side 44*b*2 extend form the fixing part 44*b* to the bonding part 44*a*. The hook fixing part 44*b* is open at the bottom 44*b*3. If water enters the inner cavity of the cowling 7 of the outboard motor 1, the closed upper side 44*b*1 can keep the water away from the mounting part. The hook fixing part 44*b* in a box shape can also enhance the strength of the hook mounting member 44. In some embodiments, a person can manually hold the hook mounting member 44 from the underside of the hook fixing part 44*b*, which helps one easily assemble the hook mounting member 44. For example, the hook fixing part 44*b* can be spaced from the wall 140 such that a person's finger can fit between the wall 140 and the hook fixing part 44*b* during the assembly process.

Figure 10:
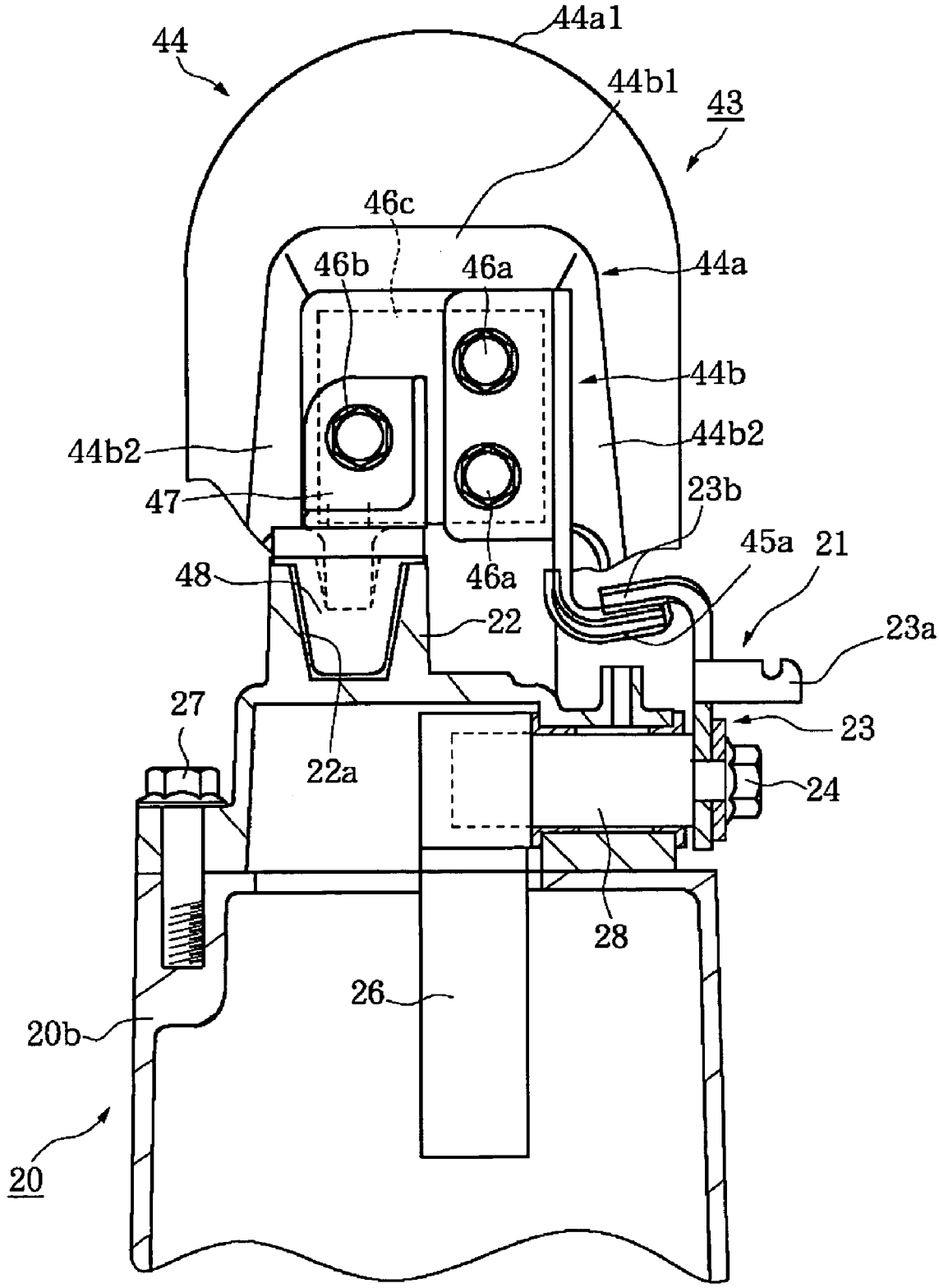
FIG. 10 illustrates the top cowl hook coupled to the bottom cowl coupling assembly of the bottom cowl.

With reference to FIGS. 8–10, the bonding part 44*a* has a generally flat face that can mate with the inner side 120 of the wall 140. The bonding part 44*a* also has an upper edge side 44*a*1 that is curved, preferably having a U-shaped profile. A left side of the upper edge side 44*a*1 extends downwardly to form a vertically oriented positioning leg 44*c*, and a right side of the upper edge side 44*a*1 extends downwardly to form another vertically oriented positioning leg 44*c*. The positioning legs 44*c* are spaced from each other and generally straight. Each positioning leg 44*c* preferably has a distal end 44*c*1 extending downward a sufficient distance so as to engage the curved part 40*a*1, as shown in FIG. 9. The curved part 40*a*1 can curve around the distal end 44*c*1. As such, the curved part 40*a*1 retains the hook mounting member 44 to limit movement of the positioning legs 44*c* away from the wall 140 of the top cowl 40. Such a configuration reduces or eliminates the need for a separate mounting structure for securing the positioning legs 44*c*, or other portions of the hook mounting member 44. The elongate positioning legs 44*c* help positioning during assembly because the distal ends 44*c*1 of the legs 44*c* can be inserted into the channel 130, thereby providing easier and more accurate assembly.

The hook fixing part 44*b* can be interposed between the nut plate 46*c* and the top cowl hook 45. In some embodiments, including the illustrated embodiment, the hooking fixing part 44*b* has a generally uniform thickness and protrudes from the wall 140. The mounting bolts 46*a* extend through the top cowl hook 45, hook fixing part 44*b*, and nut plate 46*c*. The top cowl coupling assembly 43 includes two mounting bolts 46*a* which securely couple the top cowl hook 45 to the hook fixing part 44*b*. Other coupling arrangements can also be employed.

With reference to FIGS. 8 and 10, the damper holder 47 is coupled to the hook fixing part 44*b*. In the illustrated embodiment, a mounting bolt 46*b* couples the holder 47 to the hook fixing part 44*b*, although other mounting arrangements can be employed. A positioning damper 48 (shown in phantom) is mounted to the holder 47. The positioning damper 48 can be received by the positioning recesses 22*a* of the bottom cowl coupling assembly 21 to position the bottom cowl coupling assembly 21 with respect to the top cowl coupling assembly 43. Alternatively or additionally, the bottom cowl coupling assembly 21 can have other types of alignment structures.

FIG. 10 illustrates the top cowl coupling assembly 43 releasably coupled to the bottom cowl coupling assembly 21. The engaging part 45*a* of the top cowl hook 45 is pressed against the engaging part 23*b* of the bottom cowl hook 23. In some embodiments, including the illustrated embodiment, the engaging part 45*a* is positioned below the engaging part 23*b* of the bottom cowl hook 23. The bottom cowl hook 23 can disengage the top cowl hooks 45 when the lever 26 is rotated in the direction indicated by the arrow 131 (see FIG. 7). To couple the assembles 21, 43 together, the engaging part 23*b* of the bottom cowl hook 23 is rotated by the spring 25 in the opposite direction to return to the bottom cowl hook 23 to the illustrated position.

When the top cowl 40 and bottom cowl 20 are attached to each other, the positioning damper 48 of the top cowl coupling assembly 43 is received by the positioning recess 22*a* of the bottom cowl coupling assembly 21 so as to align the coupling assemblies 21, 43. This can facilitate placement of the top cowl 40 on the bottom cowl 20. In the illustrated embodiment of FIG. 10, the positioning damper 48 and corresponding recess 22*a* each have a generally frustoconical shape; however, the damper 48 and recess 22*a* can have other shapes, if desired.

When the top cowl 40 and the bottom cowl 20 are coupled with each other, a seal member 50 forms a seal between the top cowl 40 and the bottom cowl 20, as shown in FIG. 11. Various types of seal members can be employed. The illustrated seal member 50 preferably has an engaging part 50*a* and a seal part 50*b*. The seal member 50 can be coupled to the top cowl 40 by engaging the engaging part 50*a* with the curved part 40*a*1 formed along the opening edge 40*a* of the top cowl 40. The seal member 50 can extend between along the opening edge 40*a* between the top cowl coupling assemblies 43. In some embodiments, a plurality of seal members 50 extend between the lower attaching arms 44*a* of adjacent hook mounting members 44.

When the top cowl 40 and the bottom cowl 20 are coupled together, the seal part 50*b* preferably is pressed against the rib 20*a*1 formed along the opening edge 20*a* of the bottom cowl 20 and a flat part 20*c* inside the opening edge 20*a*. A seal is formed by the curved part 40*a*1 along the opening edge 40*a* of the top cowl 40 and the opening edge 20*a* of the bottom cowl 20. The seal member 50 can be compressible so as to form a relatively good seal with ease and reliability. Although the seal member 50 is attached to the top cowl 40, alternative embodiments may have a seal member 50 attached to the bottom cowl 20. The seal member 50 can comprise a compliant material, such as rubber, polymer, or other material suitable for forming a seal, such as various elastomer materials. One of ordinary skill in the art can select the type and configuration of the seal members based on the configuration of the bottom and top cowls 20, 40.

In some embodiments, including the illustrated embodiment of FIG. 10, the hook mounting member 44 is coupled to the inner side of the opening edge 40*a* of the top cowl 40 to which the top cowl hook 45 is mounted. The top cowl hook 45 and the bottom cowl hook 23 are engaged with each other. The hook mounting structure 44 is thus not visible from outside of the assembled cowling 7, thereby maintaining an improved appearance. As mentioned above, the top cowl 40 and the hook mounting member 44 can comprise the same material, e.g., nonferrous metal, such as aluminum and/or magnesium. Such an embodiment can be lightweight as compared to the cowlings made of reinforced resin. Additionally, corrosion of the hook fixing member 44*b* can be reduced as compared to cowlings made of different materials which contact each other.

The hook mounting member 44 has the hook fixing part 44*b* formed by a drawing process, preferably preformed in conjunction with the pressing process. This can reduce costs and the distance between the hook fixing part 44*b* and the wall 140 of the top cowl 40. In some embodiments, the hook fixing part 44*b* is spaced from the wall 140 of the top cowl 40 such that a person's finger can be positioned between the hook fixing part 44*b* and the wall 140 of the top cowl 40.

The top cowl hook 45 and the bottom cowl hook 23 can engage each other when the upper cowl 40 is positioned on the bottom cowl 20. The bottom cowl 20 can exert a downwardly directed force on the top cowl hook 45, which is supported by the bonding part 44*a* of the hook mounting member 44. The upper edge side 44*a*1 of the bonding part 44*a*, formed into an arc shape, allows this force to be decentralized and minimizes stress concentrations, thereby enhancing the overall bonding strength between the top cowl coupling assembly 43.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. An outboard motor comprising a cowling being configured to enclose an engine therewithin, the cowling comprising a top cowl and a bottom cowl, the top cowl comprising a top cowl opening edge and a top cowl coupling assembly, the top cowl coupling assembly comprising a top cowl hook and a hook mounting member being bonded to an inner side of the top cowl, the hook mounting member comprising a nonferrous metal and having a generally uniform thickness, the bottom cowl comprising a bottom cowl opening edge and a bottom cowl coupling assembly coupled to an inner side of the bottom cowl, the top cowl hook being configured to engage the bottom cowl coupling assembly so as to releasably couple the top cowl to the bottom cowl.

2. The outboard motor of claim 1, wherein the hook mounting member is a curved plate having an inwardly-extending portion that extends away from the inner side of the top cowl.

3. The outboard motor of claim 2, wherein the top cowl hook is coupled to the inwardly-extending portion.

4. The outboard motor of claim 1, wherein the hook mounting member is bonded to a portion of the top cowl that comprises a nonferrous metal.

5. The outboard motor of claim 1, wherein the hook mounting member has an outwardly extending bonding portion having an arc shaped upper edge, and the bonding portion is bonded to the inner side of the top cowl.

6. The outboard motor of claim 1, wherein the hook mounting member further comprises a hook fixing part to which the top cowl hook is coupled, the hook fixing part has an upper side, a left side, and a right side extending from a portion of the hook mounting portion, and a bottom of the hook fixing part is spaced from the inner side of the top cowl.

7. The outboard motor of claim 1, wherein the hook mounting member comprises a bonding part, the bonding part has a left side and a right side each extending downward from a bottom of the bonding part to form a left elongate positioning leg and right positioning leg, respectively, and the left and right elongate positioning legs contact an inwardly curved part of the opening edge of the top cowl.

8. The outboard motor of claim 7, wherein the inwardly curved portion forms a channel, and portions of the legs are in the channel.

9. The outboard motor of claim 1, wherein the hook mounting member is formed by a pressing process.

10. The outboard motor of claim 1, wherein the hook mounting member comprises a hook fixing part to which the top cowl hook is mounted, and the hook fixing part is formed by the way of drawing in the pressing process.

11. A cowling for an outboard motor, the cowling comprising a top cowl having an opening edge, a hook mounting plate being bonded to an inner surface of the top cowl near the opening edge, the hook mounting plate comprising a nonferrous metal and a central portion protruding from the inner surface of the top cowl, a top cowl hook being coupled to the central portion, and a bottom cowl configured to mate with the top cowl so as to enclose an engine therewithin, the bottom cowl having a bottom cowl hook coupled to an opening edge of the bottom cowl, the top cowl hook configured to releasably engage the bottom cowl hook.

12. The cowling of claim 11, wherein the hook mounting plate has a generally uniform thickness.

13. The cowling of claim 11, wherein the hook mounting plate has an outwardly extending mounting flange having a generally arc shaped profile, and the mounting flange is bonded to the inner surface of the top cowl.

14. The cowling of claim 11, wherein the central portion is distanced from the inner surface of the top cowl so as to accommodate a person's finger positioned between the central portion and the inner surface of the top cowl.

15. The cowling of claim 11, wherein the hook mounting plate comprises an upper side, left side, and right side that extend between the central portion and a mounting portion of the hook mounting plate bonded to the inner surface of the top cowl.

16. The cowling of claim 15, wherein the mounting portion comprises a pair of elongate legs, and the opening edge the top cowl extends inwardly so as to hold distal ends of the elongate legs.

17. The cowling of claim 11, wherein the hook mounting plate is formed by a pressing process.

18. The cowling of claim 11, wherein the central portion is formed by drawing during the pressing process.

* * * * *